US012146428B1

(12) United States Patent
Davis et al.

(10) Patent No.: US 12,146,428 B1
(45) Date of Patent: Nov. 19, 2024

(54) OIL MAKE-UP SYSTEM WITH SIPHON MITIGATION

(71) Applicant: Caterpillar Inc., Peoria, IL (US)

(72) Inventors: Douglas E. Davis, Lafayette, IN (US); Sudhakar Thamodharan, Zionsville, IN (US); Erik C. Wilson, Battle Ground, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/320,624

(22) Filed: May 19, 2023

(51) Int. Cl.
*F01M 1/02* (2006.01)
*F01M 11/00* (2006.01)
*F01M 11/02* (2006.01)

(52) U.S. Cl.
CPC ..... *F01M 11/0004* (2013.01); *F01M 1/02* (2013.01); *F01M 11/02* (2013.01); *F01M 2011/0095* (2013.01)

(58) Field of Classification Search
CPC ..... F01M 11/0458; F01M 11/061; F01M 2011/0466
USPC ..... 123/196 R
See application file for complete search history.

(56) References Cited

U.S. PATENT DOCUMENTS 5,078,233 A * 1/1992 Oetting ..... F01M 11/061 123/196 R
6,167,978 B1 * 1/2001 Smietanski ..... F01M 5/002 137/264
6,371,153 B1 4/2002 Fischerkeller et al.
9,109,612 B2 8/2015 Gilmore et al.
9,951,662 B2 * 4/2018 Wordsworth ..... F01M 1/12
2014/0209053 A1 * 7/2014 Norrick ..... F01M 11/061 123/196 R
2017/0089234 A1 * 3/2017 Dawson ..... F16N 39/002
2019/0203618 A1 * 7/2019 Foerster ..... F01M 11/04

FOREIGN PATENT DOCUMENTS

JP 2003176551 A 6/2003

* cited by examiner

*Primary Examiner* — Long T Tran
*Assistant Examiner* — James J Kim
(74) *Attorney, Agent, or Firm* — Bookoff McAndrews PLLC

(57) ABSTRACT

An oil make-up system for an engine of a machine includes an oil pan for supplying oil to engine components, an auxiliary oil tank positioned above the oil pan, a return including a return pump for conveying oil from the oil pan to the auxiliary oil tank, a supply including a supply pump for conveying oil from the auxiliary oil tank to the oil pan, and a siphon-terminating-connection between the supply and return.

19 Claims, 4 Drawing Sheets

OIL MAKE-UP SYSTEM WITH SIPHON MITIGATION

TECHNICAL FIELD

The present disclosure relates generally to oil systems for machines, and more particularly to an oil make-up system for an engine of a machine.

BACKGROUND

Oil-based lubrication systems are ubiquitous in modern industrial and consumer machines, includes automobiles, trucks, construction equipment, etc. Internal combustion engines in particular utilize an oil-based lubrication system that typically includes a pump which transports oil to various components requiring lubrication, and a sump which collects oil that flows back from those components. In many applications, oil must be changed at predetermined intervals as oil breaks down or otherwise become less effective. The recommended oil change interval of a particular machine may be based on several factors, such run time, distance traveled, total oil capacity of the system, and extenuating environmental circumstances. Oil changes represent a significant source of maintenance and downtime for machinery, particularly in heavy industry when any amount of downtime can have significant financial implications.

U.S. Pat. No. 6,371,153 to Fischerkeller et al. (hereinafter "the '153 patent") discloses a fuel system including first and second tank portions, and first and second fuel pumps in the first and second tank portions, respectively. The fuel system further includes a first crossover fuel line for transferring fuel from the second tank portion to the first tank portion, and a second crossover fuel line for transferring fuel from the first tank portion to the second tank portion. In one aspect of the '153 patent, the first and second tank portions define a bifurcated tank and the first and second crossover fuel lines are housed completely within the bifurcated tank. In another aspect of the '153 patent, the first and second crossover fuel lines extend partially outside the bifurcated tank.

While the '153 patent discloses a fuel tank having two portions, the '153 patent does not disclose such a tank for an oil system. Furthermore, the '153 patent does not address the challenges of implementing such a tank in an oil system, such as overfilling of an oil pan or sump which can lead to over pressurization, oil aeration and various adverse effects on the engine.

The oil make-up system of the present disclosure solve one or more of the problems set forth above and/or other problems in the art.

SUMMARY

According to one aspect of the present disclosure, an oil make-up system for an engine of a machine is disclosed. The system includes an oil pan for supplying oil to engine components, an auxiliary oil tank positioned above the oil pan, a return including a return pump for conveying oil from the oil pan to the auxiliary oil tank, a supply including a supply pump for conveying oil from the auxiliary oil tank to the oil pan, and a siphon-terminating-connection between the supply and return.

In another aspect, an oil make-up system for an engine of a machine is disclosed. The system includes an oil pan for supplying oil to engine components, an auxiliary oil tank positioned above the oil pan, a return including a return pump for conveying oil from the oil pan to the auxiliary oil tank, a supply including a supply pump for conveying oil from the auxiliary oil tank to the oil pan, and at least two siphon-terminating connections between the supply and return. The siphon-terminating connections includes a partition dividing the auxiliary oil tank into a return chamber and a supply chamber, and a bypass between the return and the supply.

In yet another aspect, a method for operating an oil make-up system to prevent overfilling of an oil pan of an engine of a machine is disclosed. The oil make-up system includes the oil pan and an auxiliary oil tank positioned above the oil pan. The method includes actuating a return pump of a return to convey oil from the oil pan to the auxiliary oil tank, actuating a supply pump of a supply to convey oil from the auxiliary oil tank to the oil pan, and breaking a siphon in the supply in response to a failure of the supply pump. Breaking the siphon in the supply comprises introducing air into the siphon via a siphon-terminating connection.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
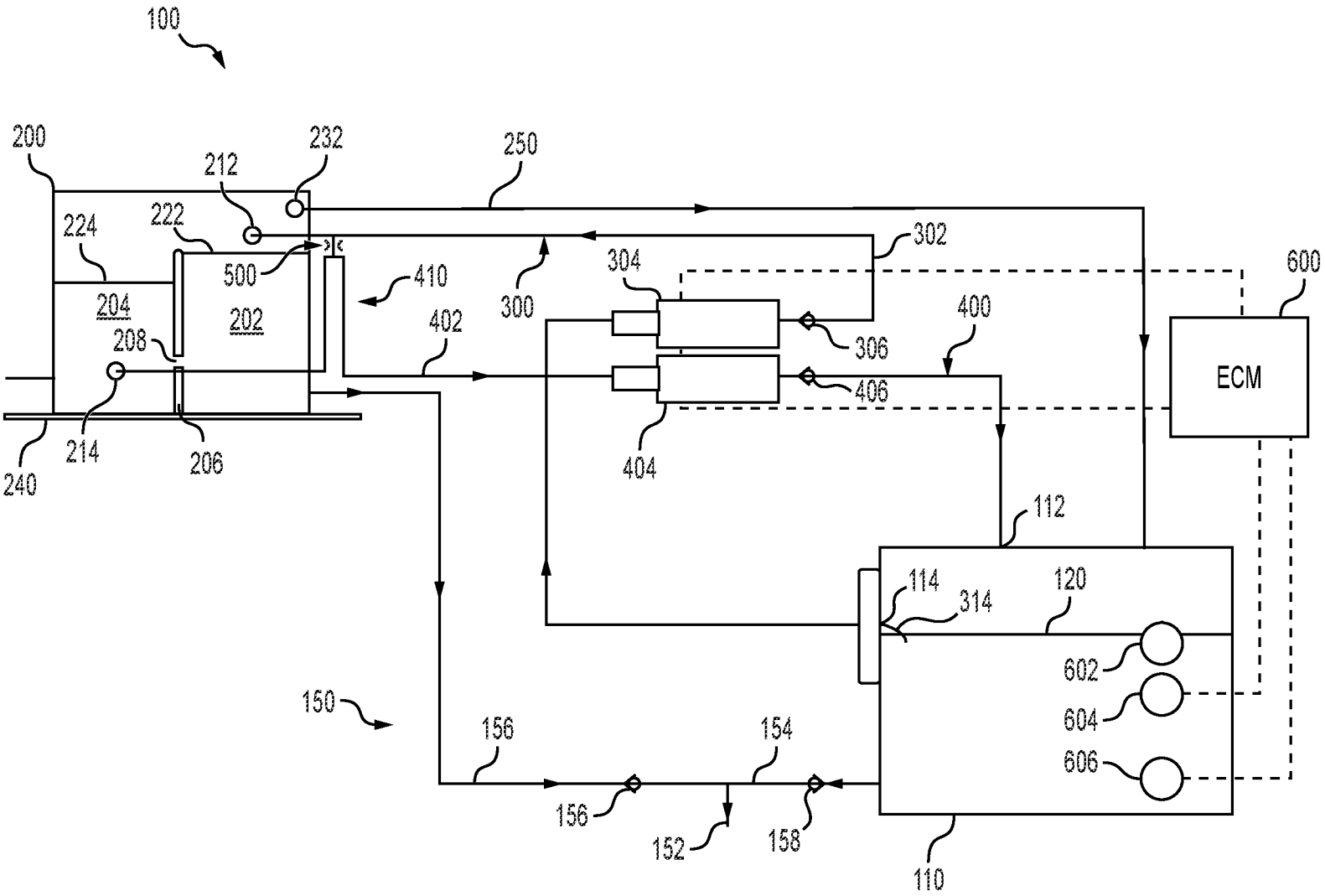
FIG. 1 is a system diagram of an oil make-up system for an engine of a machine, according to aspects of the present disclosure.

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of 10% in the stated value. Throughout the accompanying drawings, like reference numerals refer to like components.

Referring to FIG. 1, a machine, such as a mobile machine (e.g. an off-highway industrial truck such as a haul truck, or an articulated truck, a dozer, an excavator, a backhoe loader, or motor grader, etc.) includes an oil make-up system 100 for supplying oil to engine components (not shown), such as bearings, pistons, valves, crankshaft components, camshaft components, fuel injectors, etc. Oil make-up system 100 includes an oil pan 110 or sump, which is typically attached to the bottom of the engine such that oil from the various engine components drains into the oil pan 110 from where the oil is recirculated to the engine components by an oil pump (not shown). Oil make-up system 100 further includes an auxiliary oil tank 200 positioned above (i.e., at an elevation higher than) oil pan 110. For example, auxiliary oil tank 200 may be positioned on a platform 240 of the machine situated above oil pan 110.

Oil pan 110 includes an inlet 112 positioned above an optimal oil level 120 of oil in oil pan 110. Inlet 112 may be a port, channel, or any other structure through which oil can flow or drain into oil pan 110. Oil pan 110 further includes an outlet port 114 which sets an optimal oil level 120 of oil in oil pan 110. In particular, a suction tube 314 extends through outlet port 114 and has an open end through which oil is drawn from oil pan 110. Thus, optimal oil level 120 corresponds to the height of the open end of suction tube 314. In some aspects, oil make-up system 100 is retrofitted to the engine, and outlet port 114 corresponds to a port originally connected to an oil filler neck (not shown).

Figure 2:
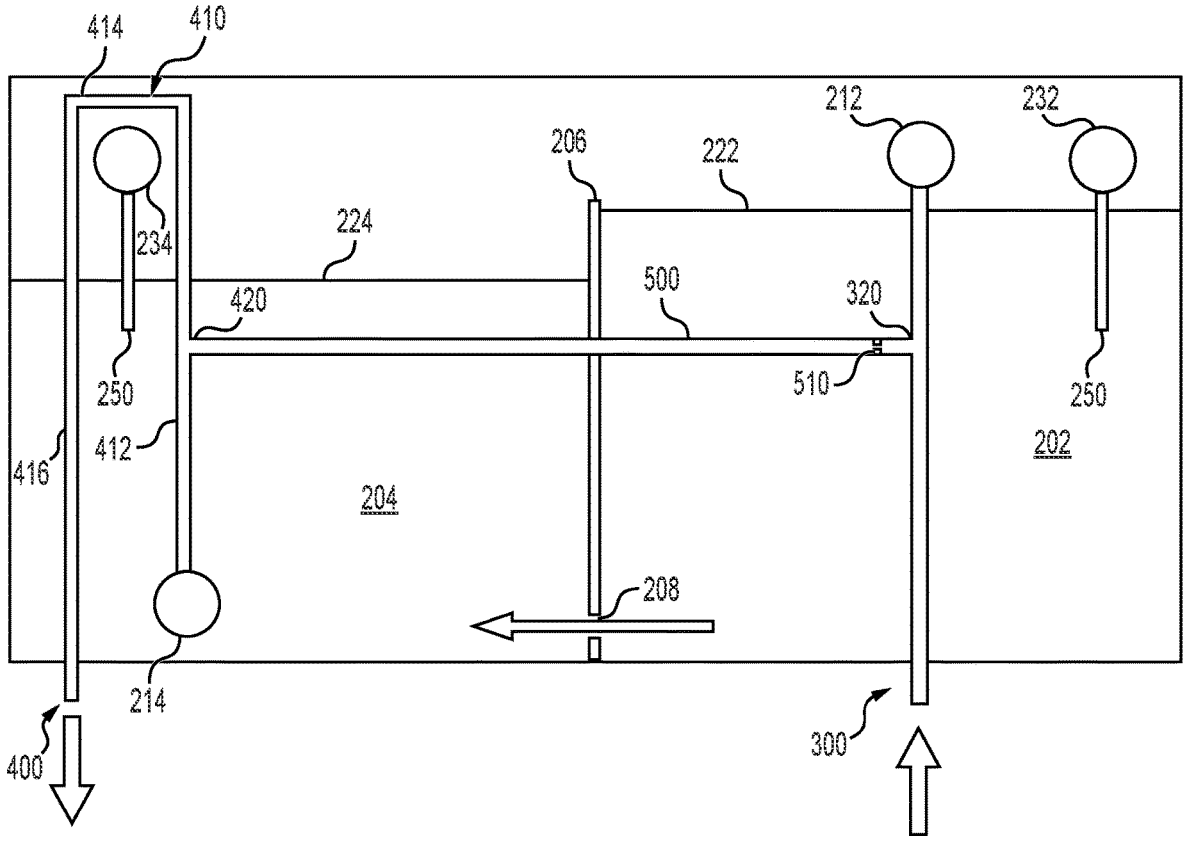
FIG. 2 is a diagram of the auxiliary oil tank and associated components of the oil make-up system of FIG. 1, according to aspects of the present disclosure.
Figure 3:
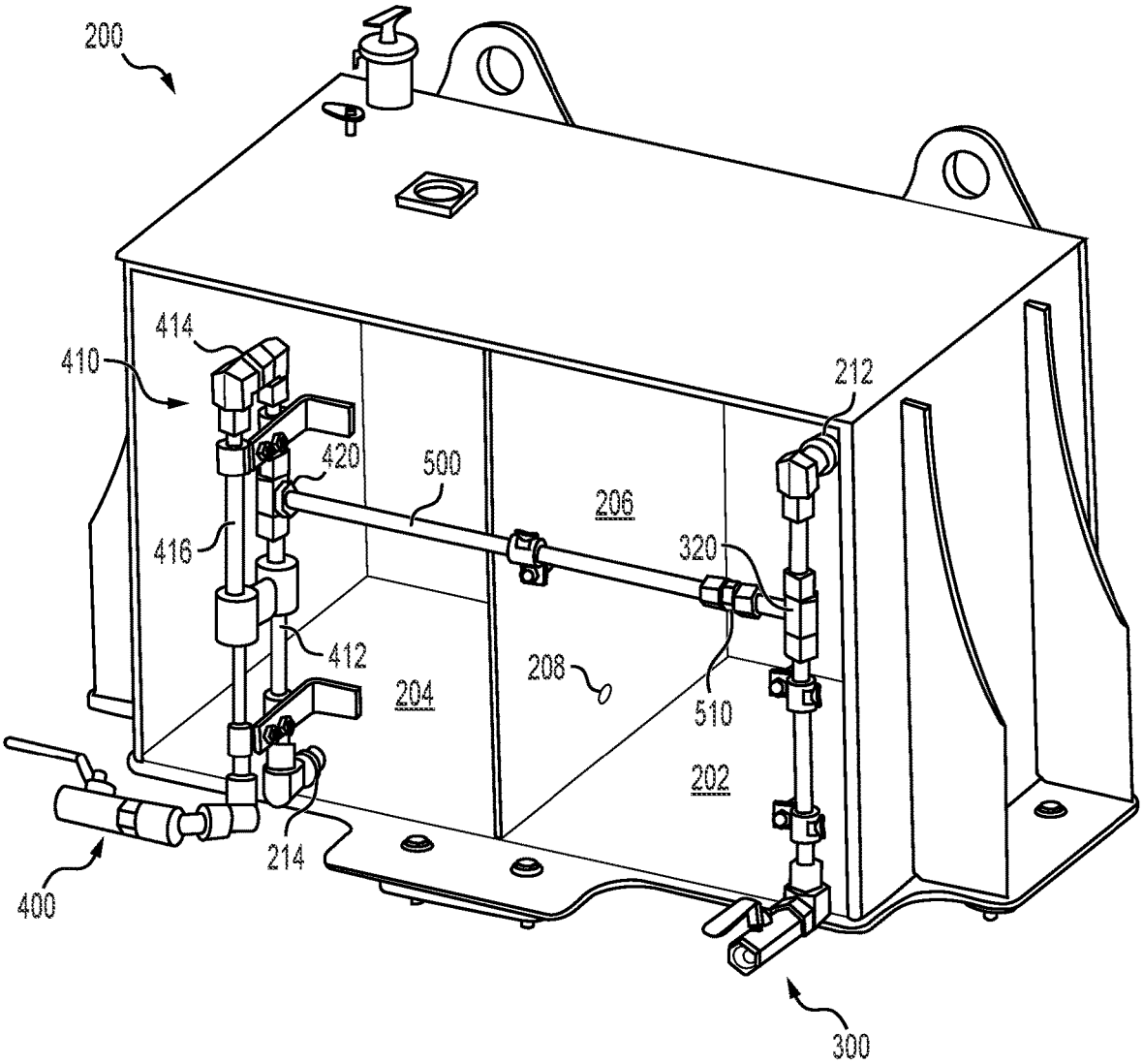
FIG. 3 is a perspective view of the auxiliary oil tank of FIGS. 1 and 2, according to aspects of the present disclosure, with a front wall shown transparently for clarity.

Referring to FIGS. 1-3, auxiliary oil tank 200 includes two chambers, namely a return chamber 202 which receives oil from oil pan 110 and a supply chamber 204 which supplies oil to oil pan 110. Note that FIGS. 1-3 all show the same features of auxiliary oil tank 200, with FIGS. 1 and 2 showing a schematic representation of auxiliary oil tank 200 schematically and FIG. 3 showing a structural representation of auxiliary oil tank 200. An inlet port 212 of auxiliary oil tank 200 is in fluid communication with return chamber 202, and an outlet port 214 of auxiliary oil tank 200 is in fluid communication with supply chamber 204. Inlet port 212 may be located above an oil level 222 in return chamber 202 so that incoming oil from oil pan 110 flows from inlet port 212 into return chamber 202 due to gravity. Outlet port 214 may be located below an oil level 224 in supply chamber 204. Return chamber 202 and supply chamber 204 are partitioned from one another so that flow between return chamber 202 and supply chamber 204 may only occur via a desired flow channel. In some aspects, return chamber 202 and supply chamber 204 may be separated by a partition 206 extending across an interior of auxiliary oil tank 200. In other aspects (not shown), return chamber 202 and supply chamber 204 may be distinct tanks together forming auxiliary oil tank 200. In some aspects, return chamber 202 may be smaller (i.e. contain less volume) than supply chamber 204.

An orifice 208 fluidly connects and allows oil to flow between return chamber 202 and supply chamber 204. Orifice 208 is located below (i.e., at an elevation lower than) or at the same elevation as inlet port 212 and outlet port 214. Further, orifice 208 is located proximate to the bottom of return chamber 202 and supply chamber 204 so that oil flow between return chamber 202 and supply chamber 204 even when the overall oil volume in auxiliary oil tank 200 is relatively low. Orifice 208 may be sized so as to limit the flow rate of oil through orifice 208 to a desired flow rate. In aspects in which return chamber 202 and supply chamber 204 are separated by partition 206, orifice 208 is an aperture in partition 206. During steady-state operation of oil make-up system 100, oil flows into return chamber 202 via inlet port 212, through orifice 208 of partition 206, and into supply chamber 204. In aspects in which return chamber 202 and supply chamber 204 are distinct tanks, orifice 208 may be a tube or the like that connects the two tanks forming return chamber 202 and supply chamber 204, respectively.

As shown in FIGS. 1 and 2, auxiliary oil tank 200 may further includes one or more vents 232, 234. Vent 232 may by located above oil level 222 or return chamber 202, and vent 234 may be located above oil level 224 of supply chamber 204. In some aspects, only a single one of vents 232, 234 may be utilized where, as in the illustrated aspect, air can flow freely between return chamber 202 and supply chamber 204 over partition 206. Vents 232, 234 are connected to oil pan 110 via overflow 250. In particular, overflow 250 may include a hose, tube, pipe, etc. connected to a portion of the engine above oil pan 110 such that oil flowing out of overflow 250 flows into oil pan 110.

With continued reference to FIGS. 1-3, auxiliary oil tank 200 is fluidly connected to oil pan 110 by a return 300 and a supply 400. Return 300 may include a series of pipes, hose(s), tubing, and/or fitting(s) forming a fluid pathway 302 that connects outlet port 114 of oil pan 110 to inlet port 212 of auxiliary tank 200. Return 300 may include suction tube 314 extending through outlet port 114 of oil pan 110 and below oil level 120 in oil pan 110 so that oil can be sucked into fluid pathway 302 via suction tube 314. Return 300 includes a return pump 304 in-line with fluid pathway 302 which conveys oil in a direction from oil pan 110 to auxiliary oil tank 200. Return 300 may include one or more one-way valves 306 (e.g., check valves) located, for example, downstream of return pump 304 to prevent backflow of oil in fluid pathway 302 in a direction from auxiliary oil tank 200 to oil pan 110. Because inlet port 212 of auxiliary oil tank 200 is located above oil level 222 (see FIG. 2) in return chamber 202 of auxiliary oil tank 200, oil cannot backflow from auxiliary oil tank 200 into return 300.

Supply 400 may include a series of pipes, hose(s), tubing, and/or fitting(s) forming a fluid pathway 402 that connects outlet port 214 of auxiliary tank 200 to inlet 112 of oil pan 110. Supply 400 includes a supply pump 404 in-line with fluid pathway 402 which conveys oil in a direction from auxiliary oil tank 200 to oil pan 110. Supply 400 may include one or more one-way valves 406 (e.g., check valves) located, for example, downstream of supply pump 404 to prevent backflow of oil in fluid pathway 402 in a direction from oil pan 110 to auxiliary oil tank 200.

Supply 400 includes a trap 410 extending vertically above a maximum oil level in auxiliary oil tank 200. As shown in FIGS. 2 and 3, trap 410 includes an up-pipe 412 extending substantially vertically from outlet port 212 of auxiliary oil tank 200, a bend 414 of approximately 180° extending from an upper end of up-pipe 412, and a down-pipe 416 extending substantially vertically from bend 414 toward supply pump 404. The uppermost section of trap 410, namely bend 414, is vertically above the maximum oil level in supply chamber 204 of auxiliary oil tank 200. Thus, oil cannot flow from supply chamber 204 through trap 410 under gravity alone. Rather, supply pump 404 must be actuated in order to pump oil from supply chamber 204 through trap 410. Once oil has begun flowing through trap 410, a siphon in created in trap 410 such that oil will continue to flow through trap 410 even if supply pump 404 fails in an open position (i.e., if supply pump 404 fails in a manner that allows oil flow through supply pump 404).

Oil make-up system 100 includes at least one siphon-terminating connection between return 300 and supply 400. Siphon-terminating connection is configured to break the siphon created in trap 410 to ensure that oil from auxiliary oil tank 200 cannot overfill oil pan 110. Siphon-terminating connection is configured to introduce air into trap 410 to break the siphon. In some aspects, siphon-terminating connection includes partition 206 and orifice 208. Partition 206 and orifice 208 may particularly act as siphon-terminating connection during steady-state operation of the engine (i.e., when the engine is running) and supply pump 404 fails. Orifice 208 is sized so that a maximum flow rate through orifice 208 is less than a maximum flow rate of a siphon created in trap 410. In some aspects, orifice 208 may have an internal diameter of about 2 millimeters to about 5 millimeters. Due to the flow restriction imposed by orifice 208, oil level 224 in supply chamber 204 may be less than oil level 222 in return chamber 202 if oil is pumped and/or siphoned from supply chamber 204 at a flow rate greater than the flow rate of oil through orifice 208. As such, the siphon in trap 410 will drain supply chamber 204 faster than supply chamber 204 can be replenished with oil from return chamber 202 via orifice 208. If the siphon in trap 410 drains oil in supply chamber 204 below outlet port 214, the siphon will suck air from supply chamber 204, terminating the siphon in trap 410 and stopping flow of oil through supply 400 to oil pan 110.

With continued reference to FIGS. 1-3, return 300 and supply 400 may be fluidly connected via a bypass 500. As shown in FIGS. 2-3, bypass 500 extends from a bypass inlet 320 of return 300 to a bypass outlet 420 of supply 400. Bypass inlet 320 is located at a portion of return 300 downstream of return pump 304. Bypass outlet 420 is located at a portion of supply 400 upstream of (or at) bend 414 of trap 410. In the illustrated aspect, bypass outlet 420 is located on up-pipe 412 of trap 410. Bypass 500 may include an orifice 510 configured to allow a limited amount of fluid flow though bypass 500 from bypass inlet 320 to bypass outlet 420, under certain operating conditions of the engine. In particular, orifice 510 is choked with oil from return 300 when the engine is running, but acts as an air vent when the engine is not running. In some aspects, orifice 510 may have an inner diameter of about 2 mm.

In some aspects, the siphon-terminating connection of oil make-up system 100 includes bypass 500 and orifice 510. Bypass 500 and orifice 510 particularly act as a siphon-terminating connection when the engine, including return pump 304, is shut off such that no oil is flowing through return 300. When no oil is flowing in return 300, a portion of return pathway 302 between bypass inlet 320 and inlet port 212 of auxiliary foil tank 200 is filled with air because inlet port 212 is above oil level 222 of return chamber 202. If a siphon is present in trap 410 of supply 400, the siphon pulls air through bypass 500 into up-pipe 412 of trap 410, thereby introducing air into the siphon and terminating the siphon.

In some aspects, oil make-up system 100 includes multiple siphon-terminating connections, such as a first siphon-terminating connection including orifice 208, and a second siphon-terminating connection including orifice 510.

Referring again to FIG. 1, oil make-up system 100 further includes an electronic control module (ECM) 600 for actuating return pump 304 and supply pump 404. Return pump 304 and supply 404 run continuously when the engine is running. Oil make-up system 100 further includes oil level sensors 602, 604, 606 in oil pan 110. Full sensor 602 is located at a level in oil pan 110 corresponding to optimal oil level 120. Full sensor 602 may communicate with a signal, such as a light, which indicates when oil in oil pan 110 is full. The light may be located remote from oil pan 110, such as on a bumper of the machine or another conspicuous location so that the operator can observe the fill level of oil pan 110. In some aspects, the light is configured to illuminate when oil in oil pan 110 is at the level of full sensor 602, and the light is configured to turn off if the oil in oil pan 110 is low.

Add sensor 604 is located below full sensor 602 in oil pan 110, and corresponds to an oil level lower than optimal oil level 120. Low sensor 606 is located below add sensor 604 in oil pan 110, and may correspond to a level of oil that is harmful to operation of the engine. Add sensor 604 and low sensor 606 may be in electrical communication with ECM 600. If oil in oil pan 110 falls below add sensor 604 and/or low sensor 606, ECM 600 may actuate signal(s), such as light(s), on a dashboard of the machine to alert the operator that oil make-up system 100 is malfunctioning, or the oil level is otherwise low.

With continued reference to FIG. 1, oil make-up system 100 further includes a drain 150 through which oil pan 110 and auxiliary oil tank 200 can be drained, such as during an oil change. Drain 150 includes a drain port 152 located below (i.e., at an elevation lower than) oil pan 110 and auxiliary oil tank 200 so that oil from oil pan 110 and auxiliary oil tank 200 flows toward drain port 152 due to gravity when drain port 152 is opened. In the illustrated aspect, oil pan 110 and auxiliary oil tank 200 share drain port 152 in common, allowing oil pan 110 and auxiliary oil tank 200 to be drained in tandem from a single location. A pan drain line 154 extends from oil pan 110 to drain port 152, and a tank drain line 156 extends from auxiliary oil tank 200 to drain port 152. Pan drain line 154 includes a one-way valve 158 (e.g., a check valve) that permits oil flow only in a direction from oil pan 110 toward drain port 152, thereby preventing oil from auxiliary oil tank 200 from flowing into oil pan 110 via pan drain line 154. Similarly, tank drain line 156 includes a one-way valve 160 (e.g., a check valve) that permits oil flow only in a direction from auxiliary oil tank 200 toward drain port 152. In other aspects not shown, oil pan 110 and auxiliary oil tank 200 may have separate, independent drains.

INDUSTRIAL APPLICABILITY

The disclosed aspects of oil make-up system 100 as set forth in the present disclosure may be used to increase the oil capacity, and thus extend the oil change interval, of machines such as mobile machines (e.g., trucks or construction machines). During steady-state operation of the machine, return pump 304 conveys oil from oil pan 110 to auxiliary oil tank 200, while supply pump 404 conveys oil from auxiliary oil tank 200 to oil pan 110. Thus, oil is continuously circulated between oil pan 110 and auxiliary oil tank 200 during operation of the engine. The total oil capacity of the machine having oil make-up system 100 may be greater than the oil capacity of a similar machine lacking oil make-up system 100. Thus, a greater volume of oil may be present in the machine, so wear is distributed over a greater volume of oil. As such, the oil change intervals for the machine may be less frequent relative to a machine which does not include oil make-up system 100.

Moreover, oil make-up system 100 as set forth in the present disclosure helps to prevent siphoning of oil from auxiliary oil tank 200 into oil pan 110 as a result of auxiliary oil tank 200 being positioned above oil pan 112. As such, oil make-up system 100 may prevent overfilling of oil pan 110 which can lead to oil aeration, high crankcase pressure leakage, and other undesired effects. The siphon-terminating connection(s) of oil make-up system 100 can prevent siphoning of oil into oil pan 110 during both operation of the machine, and when the machine is shut down.

Figure 4:
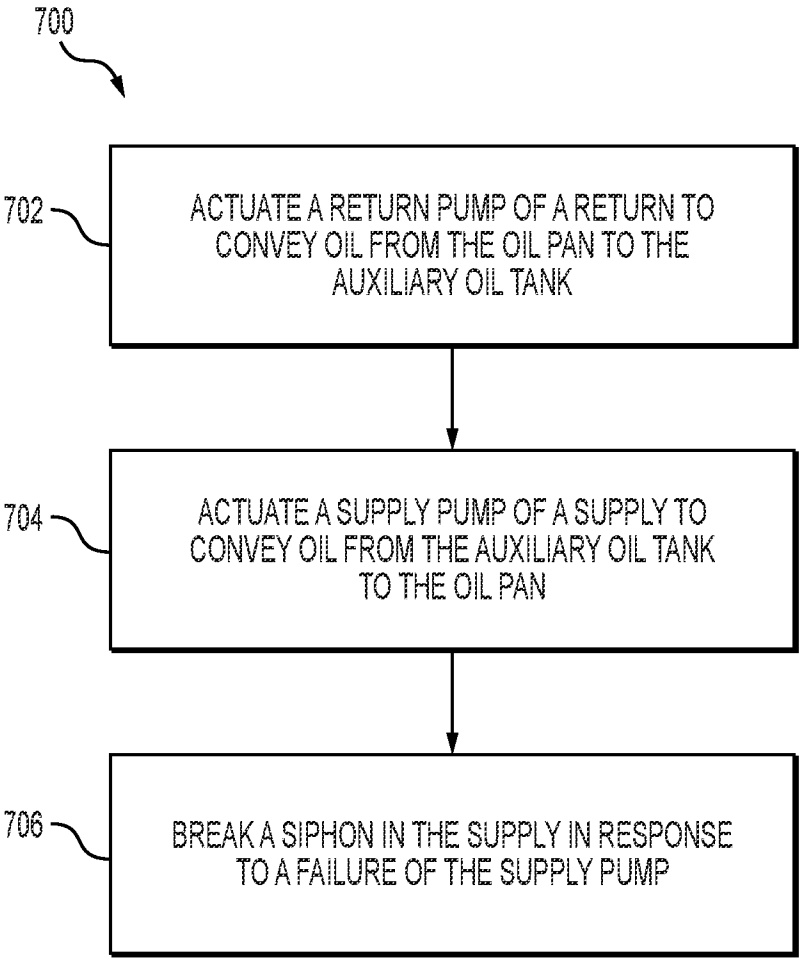
FIG. 4 provides a flowchart depicting an exemplary method for operating the oil make-up system of FIG. 1 while the engine of the machine is in operation, according to aspects of the present disclosure.

Referring now to FIG. 4, illustrated is a flow diagram illustrating an exemplary method 700 for operating oil make-up system 100. Method 700 is representative of operation of oil make-up system 100 when the machine is in steady-state operation (i.e. when the engine is running). Method 700 may prevent overfilling of oil pan 110 due to siphoning of oil from auxiliary oil tank 200. Method 700 includes, at step 702, actuating return pump 304 to convey oil from oil pan 110 to auxiliary oil tank 200. Actuating return pump 304 causes oil to flow through return 300 and into return chamber 202 of auxiliary oil tank 200 via inlet port 212. Return pump 304 may operate at a flow rate of, for example, about 8 gallons per hour (GPH).

Method 700 may further include, at step 704, actuating supply pump 404 to convey oil from auxiliary oil tank 200 to oil pan 110. Actuating supply pump 404 causes oil to flow through supply 400 and into oil pan 110 via inlet 112. Supply pump 404 may operate at a flow rate less than the flow rate of return pump 304, for example about 2 gallons per hour (GPH). As a result of supply pump 404 conveying oil through supply 400, a siphon is created in trap 410. The siphon causes oil to continue to flow through supply 400 to oil pan 110 even if supply pump 400 fails in an open state (i.e. if supply pump fails in a manner that allows oil to flow through supply pump). Steps 702 and 704 may be performed concurrently, and continuously, during normal operation of the machine.

Method 700 further includes, at step 706, breaking the siphon in trap 410 of supply 400. Step 706 is performed automatically in response to supply pump 404 failing in an open state. The siphon is broken by siphon-terminating connection introducing air into the siphon in trap 410. In particular, siphon-terminating connection, namely orifice 208 in partition 206 of auxiliary oil tank 200, limits the flow of oil into supply chamber 204 to a flow rate lower than the flow rate at which oil is pulled from supply chamber 204 by the siphon in trap 410. As such, oil level 224 (see FIG. 2) in supply chamber 204 is reduced by the siphon in trap 410 until oil level 224 drops below the height of outlet port 214. Outlet port 214 is then in fluid communication with air in supply chamber 204. The siphon in trap 410 thus draws air through outlet port 214 and into up-pipe 412, which breaks the siphon in trap 410.

After the siphon in trap 410 has been broken, oil from return chamber 202 may continue to flow into supply chamber 204 via orifice 208. However, oil in supply chamber 204 cannot flow to oil pan 110 in the absence of the siphon broken at step 706. Particularly, because bend 414 of trap 410 is located above the maximum height of oil level 224 in supply chamber 404, oil cannot flow through trap 410 to reach oil pan 110. As such, breaking the siphon at step 706 halts flow of oil from auxiliary oil tank 200 to oil pan 110, thereby preventing overfilling of oil pan 110.

Flow through supply 400 to oil pan 110 cannot resume until supply pump 404 is repaired and actuated. If return pump 304 is still being actuated, as during running of the engine, oil will flow to auxiliary oil tank 200 from oil pan 110 via return 300 until oil level in return chamber 202 reaches vent 232 and/or vent 234. Oil then flows through vent(s) 232, 234, through overflow 250, and back to oil pan 110. Thus, the engine may continue to operate utilizing the oil returned to oil pan 110 via overflow in the event of a failure of supply pump 404.

Figure 5:
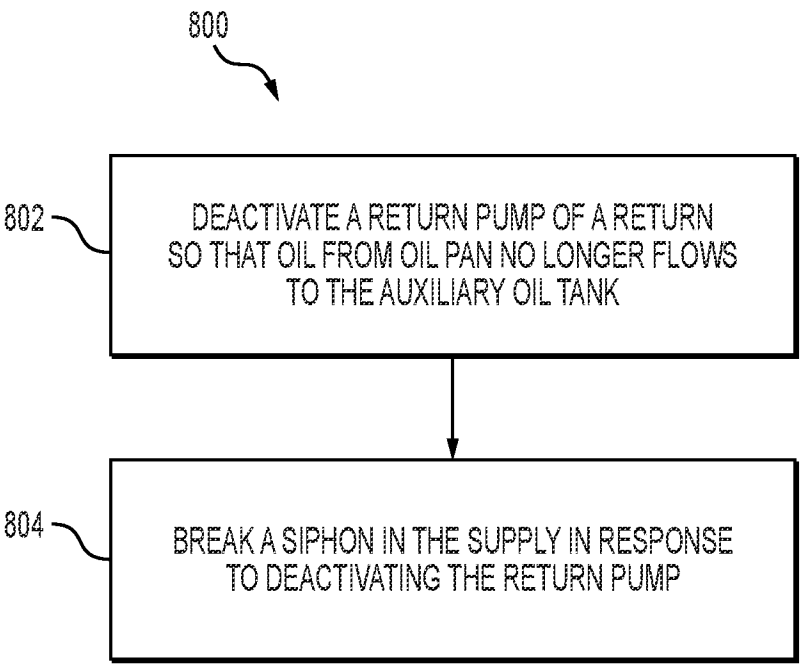
FIG. 5 provides a flowchart depicting an exemplary method for operating the oil make-up system of FIG. 1 while the machine is not in operation, according to aspects of the present disclosure.

Referring now to FIG. 5, illustrated is a flow diagram illustrating an exemplary method 800 for operating oil make-up system 100. Method 800 is representative of the operation of oil make-up system 100 when the machine is turned off (i.e. when the engine is not running). Method 800 prevents overfilling of oil pan 110 due to siphoning of oil from auxiliary oil tank 200. Method 800 may be performed in response to a failure of supply pump 404 that leaves supply pump 404 in an open state so that oil can flow through supply pump 404 when the engine, including the supply pump 404 and return pump 304, is not running. As noted above, prior to the engine being turned off, supply pump 404 creates a siphon in trap 410 which pulls oil from auxiliary oil tank 200 to oil pan 110. Thus, after turning off the engine, and there is a failure of the supply pump 404 that permits oil flow through the supply pump 404 even when the engine is turned off, overfilling of the oil pan 110 may occur.

Method 800 includes, at step 802, deactivating return pump 304. Deactivating return pump 304 may be performed commensurate with shut down of the engine, such as after use of the machine. As a result of deactivating return pump 304, oil from oil pan 110 no longer flows through return 300 to auxiliary oil tank 200. Further, the siphon in trap 410 pulls oil from return 300 through bypass 500 until the oil level in return pathway 302 drops below bypass inlet 320. As such, bypass inlet 320 is in fluid communication with air via inlet port 212 of auxiliary oil tank 200.

Method 800 further includes, at step 804, breaking the siphon in trap 410. Step 804 is performed automatically in response to return pump 304 being deactivated at step 802. The siphon is broken by siphon-terminating connection allowing air to enter trap 410. In particular, orifice 510 of bypass 500 allows air to flow from bypass inlet 320 of return 300 into bypass outlet 420 of supply 400. As such, air is introduced into the siphon in trap 410, breaking the siphon.

After the siphon in trap 410 has been broken, oil from return chamber 202 may continue to flow into supply chamber 204 via orifice 208. However, oil in supply chamber 204 cannot flow to oil pan 110 in the absence of the siphon broken at step 804. Particularly, because bend 414 of trap 410 is located above the maximum height of oil level 224 in supply chamber 404, oil cannot flow through trap 410 to reach oil pan 110. As such, breaking the siphon at step 804 halts flow of oil from auxiliary oil tank 200 to oil pan 110, thereby preventing overfilling of oil pan 110. Flow through supply 400 to oil pan 110 cannot resume until supply pump 404 is repaired and actuated.

As noted above, method 700 may be automatically performed to break a siphon in supply 400 when the engine of the machine is running. Additionally, method 700 may also automatically occur to break a siphon in supply 400 when the engine is not running, concurrently with method 800. That is, both methods 700 and 800 can stop a siphon when the engine is not running. Because method 700 includes, at step 706, oil flowing from supply chamber 204 of auxiliary oil tank 200 until the oil level in supply chamber 204 falls below outlet port 214, method 700 may take significantly longer to complete than method 800. Method 800 is completed relatively quickly, as the siphon is broken at step 804 without requiring significant draining of oil from auxiliary oil tank 200. Thus, if methods 700 and 800 are initiated simultaneously, method 800 will break a siphon in supply 400 before method 700.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. An oil make-up system for an engine of a machine, the system comprising:

an oil pan for supplying oil to engine components;

an auxiliary oil tank positioned above the oil pan;

a return for conveying oil from the oil pan to the auxiliary oil tank, the return including a return pump;

a supply for conveying oil from the auxiliary oil tank to the oil pan, the supply including a supply pump; and a siphon-terminating-connection between the supply and return that includes an orifice fluidly connecting a return chamber and a supply chamber of the auxiliary oil tank.

2. The system as claimed in claim 1, wherein the return chamber and the supply chamber are separated by a partition in which the orifice is disposed.

3. The system as claimed in claim 2, wherein the orifice is located below an inlet port of the return chamber.

4. The system as claimed in claim 1, wherein the siphon-terminating-connection includes a bypass between the return and supply, the bypass including a bypass orifice.

5. The system as claimed in claim 4, wherein the bypass connects a portion of the return downstream of the return pump with a portion of the supply upstream of the supply pump.

6. The system as claimed in claim 5, where the portion of the supply upstream of the supply pump is a portion of a trap of the supply.

7. The system as claimed in claim 1, wherein the machine is a mobile machine and the auxiliary oil tank is located on a platform of the mobile machine.

8. An oil make-up system, for an engine of a machine, the system comprising:

an oil pan for supplying oil to engine components;

an auxiliary oil tank positioned above the oil pan;

a return for conveying oil from the oil pan to the auxiliary oil tank, the return including a return pump;

a supply for conveying oil from the auxiliary oil tank to the oil pan, the supply including a supply pump; and a siphon-terminating-connection between the supply and return, wherein the supply includes a trap, and wherein an uppermost section of the trap is located above an oil level in the auxiliary oil tank.

9. The system as claimed in claim 8, wherein the trap comprises and up-pipe, a bend, and a down-pipe.

10. An oil make-up system for an engine of a machine, the system comprising:

an oil pan for supplying oil to engine components;

an auxiliary oil tank positioned above the oil pan;

a return for conveying oil from the oil pan to the auxiliary oil tank; the return including a return pump;

a supply for conveying oil from the auxiliary oil tank to the oil pan, the supply including a supply pump; and at least two siphon-terminating connections between the supply and return, the siphon-terminating connections including:

a partition dividing the auxiliary oil tank into a return chamber and a supply chamber; and a bypass between the return and the supply.

11. The system as claimed in claim 10, wherein the supply includes a trap, and wherein an uppermost section of the trap is located above an oil level in the auxiliary oil tank.

12. The system as claimed in claim 10, wherein the partition includes an orifice connecting the return chamber and the supply chamber.

13. The system as claimed in claim 10, wherein the bypass connects a portion of the return downstream of the return pump with a portion of the supply upstream of the supply pump.

14. The system as claimed in claim 13, where the portion of the supply upstream of the supply pump is a portion of a trap of the supply.

15. A method for operating an oil make-up system to prevent overfilling of an oil pan of an engine of a machine, wherein the oil make-up system includes the oil pan and an auxiliary oil tank positioned above the oil pan, the method comprising:

actuating a return pump of a return to convey oil from the oil pan to the auxiliary oil tank;

actuating a supply pump of a supply to convey oil from the auxiliary oil tank to the oil pan; and breaking a siphon in the supply in response to a failure of the supply pump, wherein breaking the siphon in the supply comprises introducing air into the siphon via a siphon-terminating connection.

16. The method as claimed in claim 15, wherein introducing air into the siphon comprises restricting flow of oil into a supply chamber of the auxiliary oil tank so that an oil level in the supply chamber drops below an outlet port of the auxiliary oil tank.

17. The method as claimed in claim 15 wherein introducing air into the siphon comprises introducing air from the return to the supply via a bypass connecting the return and the supply.

18. The method as claimed in claim 15, wherein breaking the siphon is performed while the return pump and the engine remain actuated.

19. The method as claimed in claim 15, wherein breaking the siphon is performed while the return pump and the engine are not operating.

* * * * *